US008628147B2

(12) United States Patent
O'Neill

(10) Patent No.: US 8,628,147 B2
(45) Date of Patent: Jan. 14, 2014

(54) CONTINUOUS MINER CENTER DRUM WITH OFFSET SPLIT SURFACES

(75) Inventor: Michael L. O'Neill, Lucinda, PA (US)

(73) Assignee: Joy MM Delaware, Inc., Wilmington, DE (US)

( * ) Notice: Subject to any disclaimer, the term of this patent is extended or adjusted under 35 U.S.C. 154(b) by 269 days.

(21) Appl. No.: 12/542,206

(22) Filed: Aug. 17, 2009

(65) Prior Publication Data

US 2011/0037308 A1 Feb. 17, 2011

(51) Int. Cl.
*E21C 25/10* (2006.01)

(52) U.S. Cl.
USPC ..... 299/76

(58) Field of Classification Search
USPC ..... 299/80.1, 79.1, 75, 76, 85.1, 106, 55, 299/67, 58, 59, 34.1, 78, 53, 54, 87.1, 299/39.4–39.8, 64–66; 404/90, 132, 121, 404/122, 124
See application file for complete search history.

(56) References Cited

U.S. PATENT DOCUMENTS

| | | | | |
|---|---|---|---|---|
| 4,190,296 | A | 2/1980 | O'Dell | |
| 4,310,199 | A * | 1/1982 | Freed et al. | 299/76 |
| 4,720,207 | A * | 1/1988 | Salani | 404/90 |
| 5,507,565 | A | 4/1996 | LeBegue et al. | |
| 6,390,204 | B1 * | 5/2002 | Schafle | 172/554 |

* cited by examiner

*Primary Examiner* — Sunil Singh
(74) *Attorney, Agent, or Firm* — Michael Best & Friedrich LLP

(57) ABSTRACT

A pair of semi-cylindrical segments adapted to be connected to form a center drum of a cutter head of a mining machine. The split line between the semi-cylindrical segments is not continuous, but lies on more than one plane.

25 Claims, 4 Drawing Sheets

CONTINUOUS MINER CENTER DRUM WITH OFFSET SPLIT SURFACES

BACKGROUND

This disclosure relates to an apparatus for the cutting of earth formations and, more particularly, to drum-type cutters on mining machines.

Machines for cutting earth formations such as coal and other mineral deposits, rocky soil, etc., often employ rotary cutters comprising cylindrical cutter drums which carry pointed cutter bits. The cylindrical drums are connected to a rotary drive shaft that rotates the drums at the same time that the cutter is advanced against an earth formation to cut there through.

In some mining machines, for example, carrier arms extend forwardly from a vehicle body and carry a rotary cutter mechanism that rotates about a transverse horizontal axis. The cutter mechanism comprises a support housing and a drive shaft assembly rotatably mounted within the housing, and a series of longitudinally spaced cutter drums connected to the drive shaft assembly to be rotatably driven thereby.

Some of the cutter drums (outside drums) are located to the outside of the carrier arms and comprise one-piece cylinders that can be slid axially over the housing and suitably fastened in place. Others of the drums (inside drums) are located between the carrier arms. These inside drums cannot be conveniently removed in an axial direction and thus are usually formed of semi-cylindrical segments that can be separated radially to provide access to the support housing and drive shaft assemblies for maintenance. Such a mining machine is illustrated in O'dell U.S. Pat. No. 4,190,296, which includes a plurality of cutter drums connected to a drive shaft assembly, the cutter drums including a first pair of cutter drums located longitudinally outwardly of a pair of arms, and a second pair of drums located between the arms, each of the second drums comprising a pair of semi-cylindrical segments.

More particularly, the center drum two halves are bolted together during installation on the machine's cutter head shaft. There is therefore a seam, commonly called a "split line", at the interface between the two halves. Generally, the interface between the two halves all lies within a single plane.

An array of bit holders is welded to both halves of the drum. The axial and angular position of the bit holders is carefully selected to provide desired cutting characteristics. A welding fixture is used to provide the precise locating of the bit holders.

In some cases, the desired location of a bit holder falls on the split line (seam) in the drum. When this happens, the usual solution has been to locate the bit holder as close as possible to the desired location, while avoiding the split line. This compromised bit holder location will often result in rough cutting and failure of bits, bit holders, and drive components. Another solution, rarely used, is to weld the bit holder in the preferred location, even though that means welding it across the split line. Welding across the split line is undesirable because it must be done at machine assembly time or even underground, without the benefit of the fixture for precise positioning. The overlapping bit holder also makes later drum removal difficult. Further, the welding of a bit holder on a split line may not be as robust as a fully supported holder since the mating surfaces do not fit up perfectly.

There therefore exists a need for a continuous miner center drum in which all the bit holders can be placed in the optimum locations.

SUMMARY

This invention provides a continuous miner with a center drum in which the interface between the two halves falls in multiple planes. At certain axial locations along the drum, the interface will be stepped or offset, so as to fall clear of any bit holders in that location.

This invention will allow for smoother-cutting continuous miners by avoiding compromises in the bit pattern necessitated by the split line in the center drum.

Figure 1:
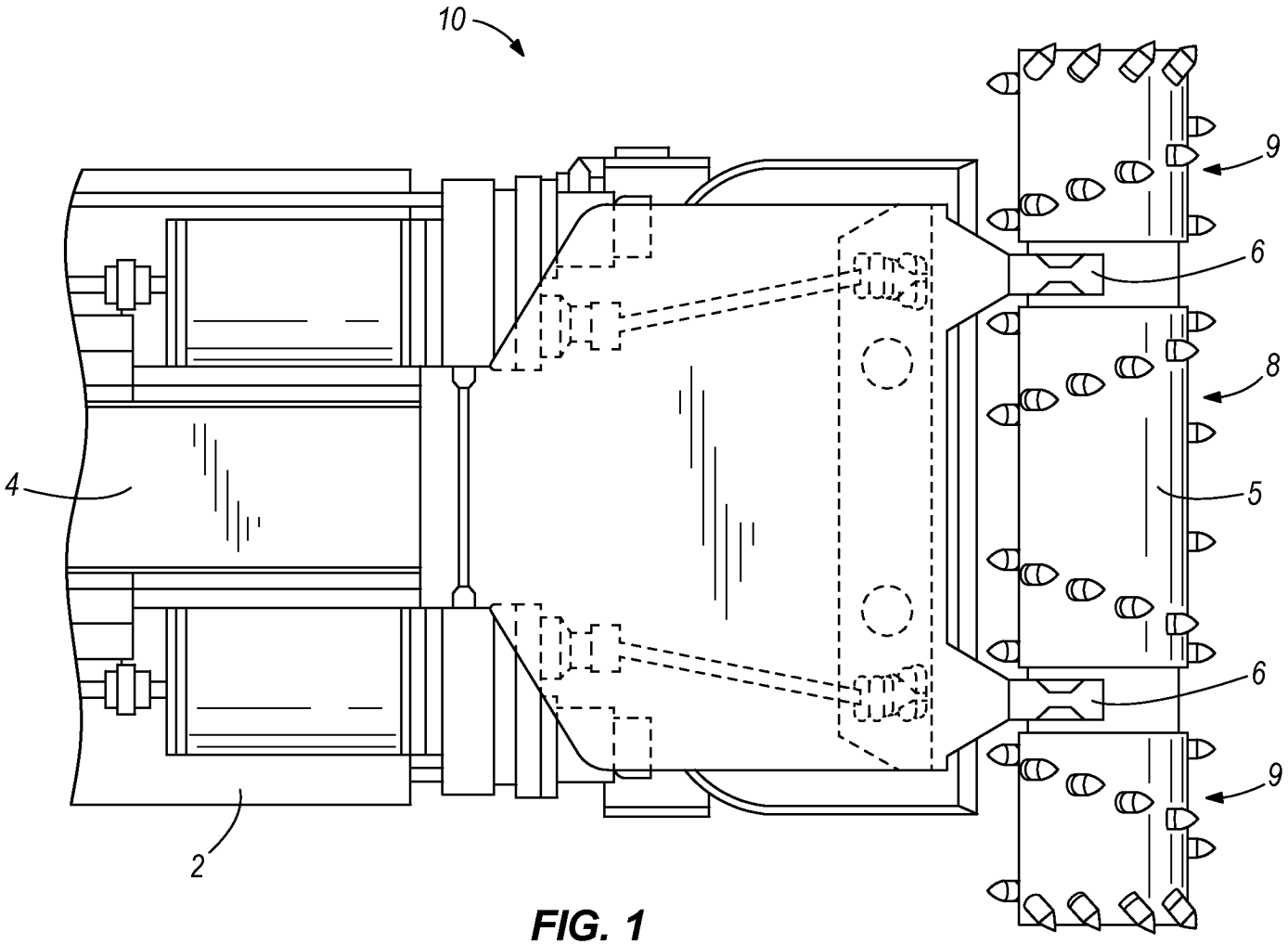
FIG. 1 is a top view of a continuous miner.

Before one embodiment of the invention is explained in detail, it is to be understood that the invention is not limited in its application to the details of the construction and the arrangements of components set forth in the following description or illustrated in the drawings. The invention is capable of other embodiments and of being practiced or being carried out in various ways. Also, it is to be understood that the phraseology and terminology used herein is for the purpose of description and should not be regarded as limiting. Use of "including" and "comprising" and variations thereof as used herein is meant to encompass the items listed thereafter and equivalents thereof as well as additional items. Use of "consisting of" and variations thereof as used herein is meant to encompass only the items listed thereafter and equivalents thereof. Further, it is to be understood that such terms as "forward", "rearward", "left", "right", "upward" and "downward", etc., are words of convenience and are not to be construed as limiting terms.

DETAILED DESCRIPTION OF PREFERRED EMBODIMENT

Figure 2:
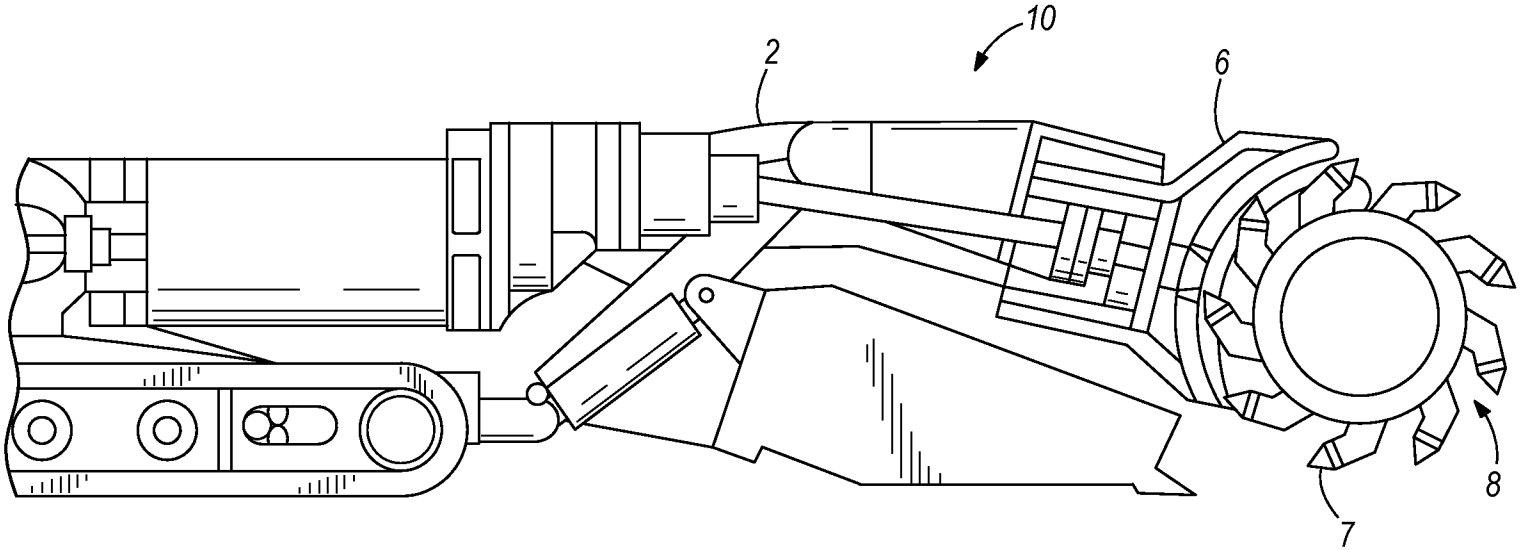
FIG. 2 is a side view of the continuous miner shown in FIG. 1.

A preferred embodiment is discussed in conjunction with a mining machine 10, as shown in FIGS. 1 and 2. The mining machine 10 comprises a self-propelled vehicle body 2. A longitudinal conveyor (not shown) on the vehicle body 2 functions to transfer excavated materials from a front end of the vehicle body 2 to a rear discharge end thereof via a conveyor 4. Extending forwardly of the vehicle body 2 is a pair of support arms 6 which support a rotary cutter assembly 8 extending across the front end of the vehicle body. The cutter assembly 8 includes a drum-type cutter mechanism 9 at each end of the cutter assembly 8, separated by a center drum 5. A plurality of cutter bit assemblies 7 are carried in a helical pattern on the outside surface of the cutter assembly 8.

Figure 3:
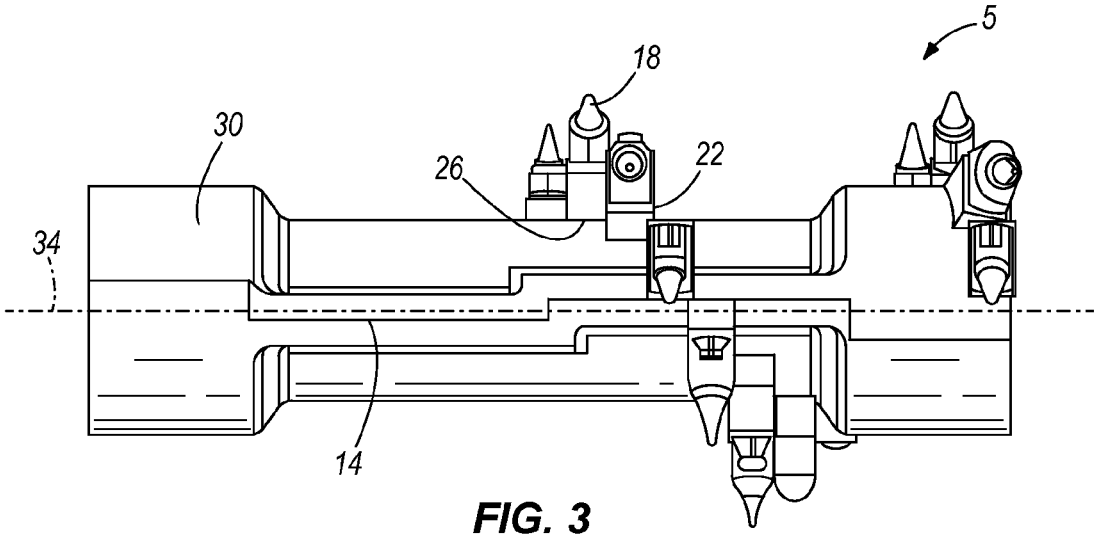
FIG. 3 is a side view of a center drum of a cutter head of a continuous miner, with a split line 14 offset in four discreet planes, with the cutter bits on the right end of the drum.

The continuous mining cutting center drum 5 shown in FIG. 3 depicts a split line 14 offset in four discreet planes. Each bit 18 is mounted to a bit holder 22, which in turn is welded at base 26 to a cylindrical drum 30 avoiding all distinct planes which define the split line 14. The axial center 34 represents the more typical split line that lies in a single plane.

Figure 4:
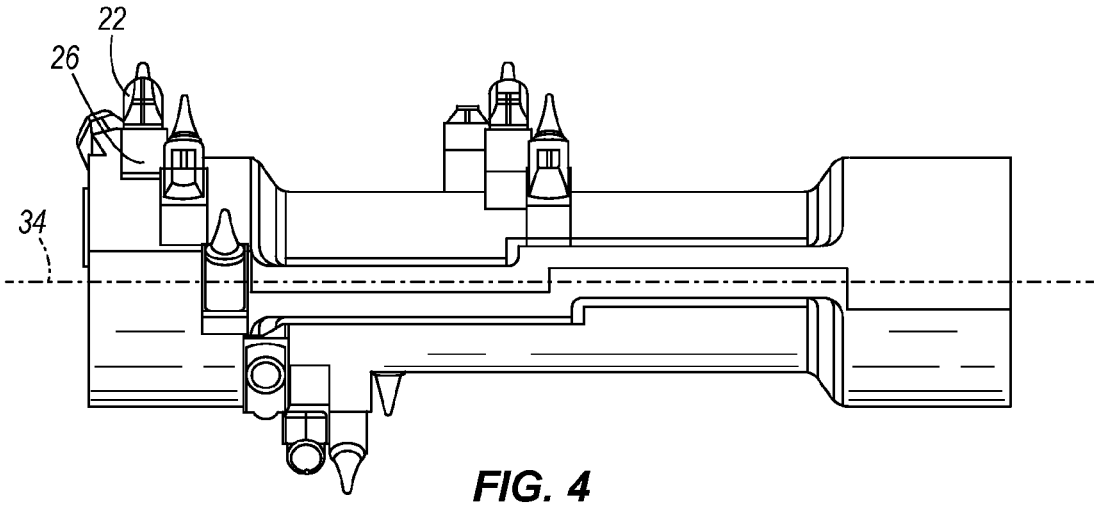
FIG. 4 is a side view of a center drum of a cutter head of a continuous miner, with a split line 14 offset in four discreet planes, with the cutter bits on the left end of the drum.

In FIG. 4, the apposing view of the cutting drum 10 depicts a common placement of a bit holder 22 overlapping the axial center 34, illustrating the compromised location of the posed bit holder 22 by present product's configuration.

In the preferred embodiment the two halves of the cylindrical drum 30 are identical before the bit holders 22 are welded to them.

It is sometimes desired to angularly offset the bit pattern on one side of the axial center 34 of the cylindrical drum 30 relative to the other side, so that no two bits 18 strike the coal at the same time, resulting in smoother cutting. While no bit holders are shown on the left side as in FIG. 3, they would be positioned in angular positions between the bit holders on the right side, as viewed lengthwise along the axial center 34.

Figure 5:
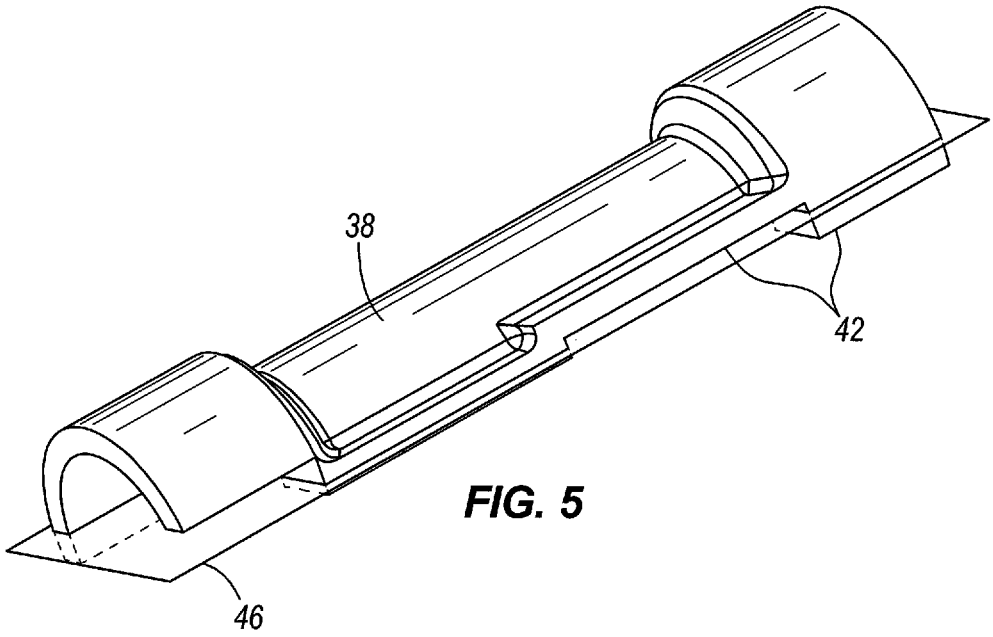
FIG. 5 is a side view of a center drum shell half with an offset split line.

FIG. 5, illustrates a drum shell half 38 with offset split line. This drum shell half 38 incorporates the extra step 42 in the split line 14 to allow the angular offset in the bit pattern as described in the preceding paragraph. The shaded plane 46 shows where the typical single-plane interface would be.

It should also be noted that in FIG. 5, the mating surfaces that make up the interface between the two drum shell halves are all parallel to each other.

Figure 6:
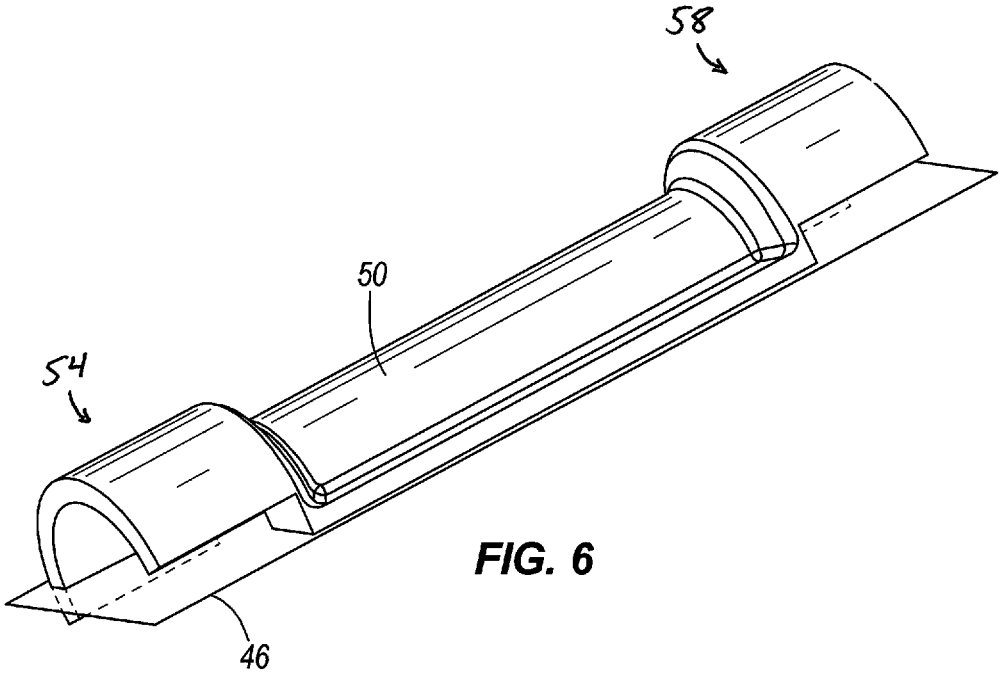
FIG. 6 is a side view of a drum shell half in which there is no extra step at the axial center.

FIG. 6 shows a drum shell half 50 in which there is no extra step at the axial center. This drum shell half 50 would be for a bit lacing pattern in which there is no angular offset in the bit pattern between the left and right sides 54, 58. In other words, the bit pattern on the right side 58 is a mirror image of the bit pattern on the left side 54.

In FIG. 6, the surfaces that make up the interface between the two halves of the drum shell are not parallel to each other, but angled.

Various other features and advantages of the disclosure are apparent from the following claims.

The invention claimed is:

1. A mining machine comprising:

a vehicle body;

a pair of arms extending forwardly from said vehicle body; and a cutter assembly mounted on the pair of arms and including a drum cutter, the drum cutter including a first drum shell half and a second drum shell half coupled to the first drum shell half to form a substantially cylindrical drum, the drum cutter defining a longitudinal axis and a central plane intersecting the longitudinal axis, a split line being defined where the first drum shell half mates with the second drum shell half, the split line defining a first mating interface offset from and parallel to the central plane and a second mating interface offset from and parallel to the first mating interface, the first mating interface and the second mating interface being offset by a step, wherein the first drum shell half and the second drum shell half are identical, wherein the first mating interface defines a first mating surface between the first drum shell half and the second drum shell half, and wherein the second mating interface defines a second mating surface between the first drum shell half and the second drum shell half, the first mating surface and the second mating surface not being parallel to each other.

2. The mining machine of claim 1, wherein the second mating interface is offset from the central plane.

3. The mining machine of claim 1, wherein the split line further defines a third mating interface offset from and parallel to the central plane.

4. The mining machine of claim 3, wherein the step is a first step, and wherein the split line further defines a fourth mating interface offset from and parallel to the third mating interface, the third mating interface and the fourth mating interface being offset by a second step extending substantially perpendicular to the central plane.

5. The mining machine of claim 4, wherein the second mating interface and the third mating interface are offset by a third step extending substantially perpendicular to the central plane.

6. The mining machine of claim 1, wherein the cutter assembly further includes a plurality of cutter bits coupled to an outside surface of the drum cutter in a helical pattern extending along the longitudinal axis.

7. The mining machine of claim 6, wherein each cutter bit includes a bit holder rigidly coupled to the outside surface of the drum cutter and not overlapping the split line.

8. The mining machine of claim 6, wherein the cutter bits form a continuous helical pattern and no two cutter bits are angularly aligned along the longitudinal axis such that when the cutter assembly rotates, no two cutting bits contact a surface at substantially the same time.

9. The mining machine of claim 6, wherein at least one cutter bit intersects the central plane.

10. The mining machine of claim 1, wherein the cutter assembly further includes a first drum cutter mechanism positioned outside the pair of arms to a first side and a second drum cutter mechanism positioned outside the pair of arms to a second side, and wherein the drum cutter is positioned between the pair of arms.

11. The mining machine of claim 1, wherein the cutter assembly further includes a plurality of cutter bits coupled to an outside surface of the drum cutter in a mirrored helical pattern extending away from a central portion of the drum cutter along the longitudinal axis.

12. The mining machine of claim 1, wherein the step extends substantially perpendicular to the central plane.

13. A drum cutter assembly for a continuous mining machine, the cutter assembly comprising:

a first drum shell half; and a second drum shell half coupled to the first drum shell half to form a substantially cylindrical drum, the substantially cylindrical drum defining a longitudinal axis and a central plane intersecting the longitudinal axis, a split line being defined where the first drum shell half mates with the second drum shell half, the split line defining a first mating interface offset from and parallel to the central plane and a second mating interface offset from and parallel to the first mating interface, wherein the first drum shell half and the second drum shell half are identical, wherein the first mating interface defines a first mating surface between the first drum shell half and the second drum shell half, and wherein the second mating interface defines a second mating surface between the first drum shell half and the second drum shell half, the first mating surface and the second mating surface not being parallel to each other.

14. The drum cutter assembly of claim 13, wherein the second mating interface is offset from the central plane.

15. The drum cutter assembly of claim 13, wherein the split line further defines a third mating interface offset from and parallel to the central plane.

16. The drum cutter assembly of claim 15, wherein the split line further defines a fourth mating interface offset from and parallel to the third mating interface.

17. The drum cutter assembly of claim 16, wherein the first mating interface is offset from the second mating interface by a first step, wherein the second mating interface is offset from the third mating interface by a second step, and wherein the third mating interface is offset from the fourth mating interface by a third step.

18. The drum cutter assembly of claim 17, wherein the first step, the second step, and the third step are each substantially perpendicular to the central plane.

19. The drum cutter assembly of claim 16, wherein none of the first mating interface, the second mating interface, the third mating interface, and the fourth mating interface is on the same plane.

20. A drum shell half for a drum cutter assembly for a mining machine, the drum cutter assembly defining a longitudinal axis and a central plane intersecting the longitudinal axis, the drum shell half being configured to couple to another drum shell half to form a substantially cylindrical drum, the drum shell half comprising:

a first mating interface for engaging the other drum shell half, the first mating interface being offset from and parallel to the central plane, the first mating interface defining a first mating surface between the drum shell half and the other drum shell half; and a second mating interface for engaging the second drum shell half, the other mating interface being offset from and parallel to the first mating interface, the second mating interface defining a second mating surface between the drum shell half and the other drum shell half, the first mating interface and the second mating interface being offset by a step, the first mating surface and the second mating surface not being parallel to each other.

21. The drum shell half of claim 20, wherein the step extends substantially perpendicular to the central plane.

22. The drum shell half of claim 20, further comprises a third mating interface for engaging the other drum shell half, the third mating interface being offset from and parallel to the central plane.

23. The drum shell half of claim 22, wherein the second mating interface is offset from the third mating interface by a second step.

24. The drum shell half of claim 23, wherein the first step and the second step are each substantially perpendicular to the central plane.

25. The drum shell half of claim 22, wherein the third mating interface defines a third mating surface between the drum shell half and the other drum shell half, the second mating surface and the third mating surface not being parallel.

* * * * *